US005335377A

United States Patent [19]

Masyada et al.

[11] Patent Number: 5,335,377

[45] Date of Patent: Aug. 9, 1994

[54] HANDICAP BATH CHAIR

[76] Inventors: Frank G. Masyada, 4416 N.W. 43rd Pl., Gainesville, Fla. 32606; Edward L. C. Williams, Box 0661, High Springs, Fla. 32643

[21] Appl. No.: 126,067

[22] Filed: Sep. 23, 1993

[51] Int. Cl.[5] ..... A47K 3/12

[52] U.S. Cl. ..... 4/578.1; 4/254; 297/152; 297/170; 297/440.1

[58] Field of Search ..... 4/254, 559, 560.1, 528.1, 4/579, 480, 576.1; 297/152, 170, 248, 252, 440.1

[56] References Cited

U.S. PATENT DOCUMENTS

| | | | |
|---|---|---|---|
| 3,854,773 | 12/1974 | Thomas | 4/254 X |
| 4,266,305 | 5/1981 | Kavaloski et al. | 4/254 X |
| 4,391,006 | 7/1983 | Smith | 4/559 |

OTHER PUBLICATIONS

Activeaid, "Tub/Commode Chair", Model 277, 2 pp., 1989.

*Primary Examiner*—Robert M. Fetsuga

*Attorney, Agent, or Firm*—Hopkins & Thomas

[57] ABSTRACT

A bath chair for handicapped users comprises a plurality of individual light weight parts which may be packed as an article of luggage and quickly and easily assembled for use. The chair has a seat frame upon which a cushion is placed, and a bench frame also having a cushion which is locked to the seat frame with a swivelly mounted protective arm therebetween. Adjustable legs on the seat frame and the bench frame permit adjustment of the chair to the desired height. A back rest is mounted on the seat frame, and a second protective arm is mounted on the other side thereof from the bench frame. Adjustable tub clamping members are detachably mounted to, and depend from, the bench frame for clamping the wall of a bathtub.

34 Claims, 6 Drawing Sheets

HANDICAP BATH CHAIR

FIELD OF INVENTION

This invention relates to a bathtub seat for handicapped persons and more particularly, to a lightweight portable bathtub chair that can readily be assembled and disassembled by the user.

BACKGROUND OF THE INVENTION

Bathtub seats for the handicapped or for persons with disabilities, such as severe arthritis, in general comprise a framework upon which a chair or seat structure having a back is fixed.

Severely handicapped persons, such as, for example, paraplegics, are at risk in using such bathtub seats inasmuch as, more often than not, such a person has no feeling in his limbs or extremities and thus cannot tell when he is properly seated. In addition, persons with balance problems should be supported laterally by the bathtub seat to prevent their falling over.

In U.S. Pat. No. 4,359,791 of Thomas, there is shown such a frame and seat assembly. In the Thomas patent, the frame has two supporting legs within the bathtub and extends over the side of the tub with two supporting legs adapted to rest upon the floor. The chair itself is adapted to move laterally by means of rollers on the frame from a position outside of the tub to a position on the frame within the confines of the tub. Such an arrangement enables the user to seat himself outside of the tub and then move laterally to a position within the tub, where the seat or chair can be locked against movement. A single lateral support arm is provided to help provide support for the person seated in the chair, and is attached to the moving seat member. The entire assembly can be folded up and stored when not in use.

The Thomas arrangement does not have any means for fixing the frame relative to the bathtub, apparently relying only on rubber tipped feet on the external legs and plastic tipped feet on the legs within the tub. Thus, it is possible for the frame to slip or tip while the user is moving from outside the tub to inside the tub. Additionally, the chair or seat has only a single arm rest, thus, one side of the seat or chair is open, without offering any lateral support to the user. Also, although the Thomas assembly can be folded, it apparently is not portable in the sense that it can be carried by the user from place to place.

In U.S. Pat. No. 4,475,256 of Hatala there is shown a shower bench which is aimed at overcoming some of the problems of the Thomas arrangement. The Hatala frame has a pair of legs within the bathtub, and a U-shaped pair of exterior legs which bear against the side of the tub. A clamping mechanism on the frame is adapted to bear against the internal side of the tub opposite the bent legs and can be screw tightened to clamp the frame to the bathtub. A chair or seat member is fastened to the frame within the tub and a pad forming an initial seat for the user extends outside the tub. In use, the user sits on the pad first, then slides over into the chair within the tub. Such an arrangement is more simple than that of Thomas in that the chair seat is not mounted on rollers. However, the Hatala arrangement only has one arm rest, at the interior end of the frame, hence users who have difficulty maintaining their balance do not have the protection that a second arm would provide. The externally mounted pad is spaced from the seat cushion to the extent that sliding from pad to seat can be uncomfortable or unpleasant. In addition, the Hatala arrangement is not amenable to being broken down into component parts and carried from place to place.

There are numerous other bathtub chair arrangements in the prior art, of varying degrees of complexity. Thus, U.S. Pat. Nos. 5,103,509 and 5,146,638 of Richards disclose bathtub seats that can be raised and lowered by electromechanical means, while U.S. Pat. No. 4,206,523 of James and U.S. Pat. No. 3,624,666 of Higgins show seats that can be raised and lowered by mechanical means. These latter arrangements require the user, or an assistant, to operate a handle in a pumping action for driving the seat up or down. None of these arrangements is susceptible to being knocked down and transported from place to place. Of the foregoing prior art patents, only the James and Richards '638 patents show arms on each side of the chair or seat that can function to protect the user, and to help the user determine when he or she is properly seated. However, these arrangements require that the chair be pivotable so that it can be turned to the side to allow ingress to and egress from, the chair. This, in turn, can introduce other problems, such as the difficulty of moving a wheelchair into position adjacent the seat for the user to move from one to the other with a minimum of effort.

None of the prior art devices discussed is truly portable in the sense that it can be knocked down into its component parts and packed in a suitcase or other means for carrying. Thus, a user of any of such devices cannot enjoy or utilize the benefits thereof when traveling, except in those rare cases where a hotel or motel may have one of the devices available, generally at additional cost.

Most of the prior art arrangements are made of metal and require significant effort to assemble and clamp in place so that they will be rigid. Where the user himself must assemble and mount the apparatus, this presents a problem especially for someone with severe arthritis, for example, where simply applying sufficient torque to tighten bolts or adjusting members can be extremely painful.

SUMMARY OF THE INVENTION

The present invention is a lightweight bathtub chair for handicapped or disabled persons that is both stable and safe, provides lateral protection for the user and can readily be assembled and disassembled by the user without using any undue effort. When disassembled into its component parts, the chair of the invention can be packed into a small case for carrying, thus enabling the user to carry it with him wherever he may go.

In an illustration embodiment of the invention, the bathtub chair comprises a base member of a sturdy, strong plastic material such as nylon, polyvinyl chloride, or glass reinforced plastic. The base member is cast or molded in a cellular fashion to reduce weight, and has a large centrally located cut-out portion which extends to the front thereof. Openings at the four corners of the base are adapted to receive the proximal ends of the four legs of the chair, each of which comprises a hollow tubular member of suitable lightweight, strong plastic material, preferably the same material as the base member. The hollow tubular members have a plurality of holes extending laterally therethrough and along a portion of the lengths of the tube from adjacent the distal end thereof. The proximal ends of the tubes are affixed to the base member by any suitable means, such as bolts, preferably of plastic or spring latches. The openings in the base member are such that proximal ends of the tubular legs fit snugly therein, hence it is only necessary to finger tighten the bolts.

Each of the tubular legs has a leg extender member adapted to slidably fit within the distal end of the leg. The leg extender is preferably made of a solid plastic material and has a single transverse hole extending therethrough. Length adjustment of the leg is achieved by aligning the hole in the extender with the desired hole in the tubular member and inserting a plastic pin therethrough to fix the extender in place. Alternatively, the leg extender may have a plurality of holes and the tubular leg only one hole. The distal ends of the leg extenders are capped with rubber pads to supply firm gripping between the chair legs and the bathtub floor without marring the surface of the bathtub.

The base member supports a seat cushion thereon having substantially the same cut-out pattern as the base member. The seat cushion has, depending from the underside thereof, projections which are dimensioned to be slip fits within cells within the base dimensioned to receive them. The cushion may comprise a flat member upon which is affixed a substantially hollow soft waterproof plastic member filled with suitable cushioning material. A cushioned back rest is also mounted to the base member by means of a back riser arm.

On either side of the base member is a chair arm, having an armrest cushion thereon. Each of the arms is so mounted that it can be pivoted back through an arc to allow access to the chair and then pivoted back to the armrest position and locked in place to provide not only armrests, but lateral restraints for the user.

A bench seat comprising a frame with a cushion member resting on top and mounted thereto in substantially the same way as the seat cushion is mounted to the base, is adapted to the mounted to either side of the base, depending upon the desired orientation of the chair. A pair of adjustable support legs support the outer side of the bench frame, each leg comprising a threaded member threaded into the frame, and a tubular lower portion having internal threads threaded onto the threaded member. A lock nut also threaded onto the threaded member can be finger tightened to fix the tubular member to the threaded member. The length of the support legs can thus be adjusted to maintain the level of the bench cushion even or roughly coplaner with the seat cushion. The distal ends of the bench support legs are capped with resilient pads or feet, preferable of rubber, to provide traction on the floor surface, which is usually at a different level than the floor of the bathtub.

Depending from the underside of the bench frame adjacent the chair base is an arm having a tub clamping pad pivotally mounted at its distal end which is adapted to bear against the interior side wall of the bathtub. Pivotally mounted at its proximal end to the outer side of the bench frame, and depending therefrom, is a second arm having a tub clamping pad pivotally mounted to its distal end. This pad is adapted to bear against the exterior side wall of the bathtub and its arm can be adjusted through an arc to accommodate to different thicknesses of tub walls, and can be finger tightened to provide lateral stability for the entire assembly of chair and bench. The pads also function to resist tipping or sliding of the chair when in use.

The bathtub chair of the invention, as can be seen from the foregoing, is light in weight, can be readily assembled and disassembled, and requires no great application of forces, e.g., torque or effort to produce a strong stable, bathtub seat providing lateral protection for the user. When assembled, the user seats himself on the bench, swings the nearest arm out of the way, and slides over onto the seat of the chair. He then lowers and locks the arm. The construction of the chair is such that it can also be used as a commode seat at whatever height is most comfortable for the user.

When disassembled, the parts can be packed in a suitcase or other carrying device for easy transport from place to place.

The various features and advantages of the present invention will be more readily apparent from the following detailed description, read in conjunction with the accompanying drawings.

DETAILED DESCRIPTION

Figure 1:
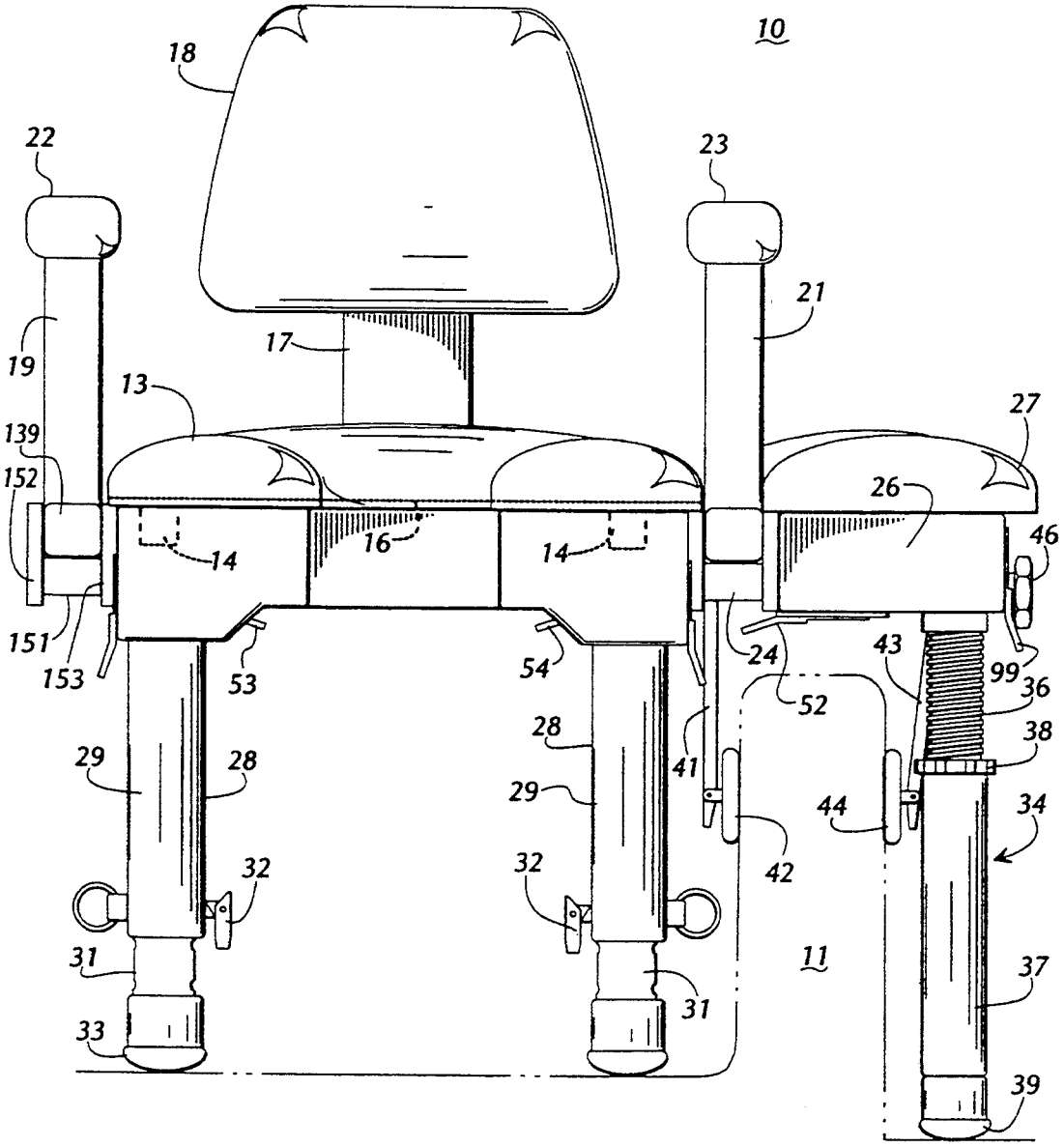
FIG. 1 is a front elevation view of the bathtub chair of the invention.

FIG. 1 is a front elevation view of a preferred embodiment of the bathtub chair 10 of the present invention as mounted in a bathtub, shown in dashed lines. Chair 10 comprises a chair seat frame 12 upon which is removably fitted a seat cushion 13. Frame 12, which will be discussed more fully hereinafter, is preferably of a molded plastic material such as, for example, a glass fiber reinforced plastic, while cushion 13 is hollow and is preferably made of a thin waterproof flexible plastic material with a suitable stuffing or filling of cushioning material. As will be apparent hereinafter, frame 12 is a cellular construction, and projections 14, depending from the bottom of the cushion 13, which may be formed as a flat plate 16 as shown in dashed lines, are adapted to fit within cells within frame 12 to hold cushion member 13 and prevent it from sliding or otherwise being displaced. A back riser 17, removably mounted to frame 12, supports a back cushion assembly 18. On either side of frame 12 are swivelly mounted arms 19 and 21 having cushioned armrests 22 and 23 respectively. Mounted on one side of frame 12 by means of a mounting or brace tube 24 is an auxiliary seat or bench frame 26 having a cushion member 27, similar to member 13 mounted thereon in a manner similar to the mounting of cushion member 13 on frame 12.

Frame member 12 and cushion 13, along with the members attached thereto constitute the main seat or chair which is supported within the bathtub 11 by means of four adjustable legs 28,28, only two of which are shown in FIG. 1, which are mountable in frame 12. Each of legs 28 comprises a hollow tubular member 29 and an extension member 31 contained within member 29 by means of a toggle pin 32. The distal end of each extension member 31 terminates in a rubber or plastic foot 33 which provides traction with the floor surface of tub 11 without marring that surface. Bench frame 26 has mounted therein two adjustable legs 34 (only one of which is shown), comprising a threaded portion 36 and an internally threaded sleeve portion 37. The distal end of sleeve 37 terminates in a rubber or plastic foot 39 which rests on the floor externally of tub 11. The length of leg 34 can be adjusted by means of the threads and locked by means of lock nut 38 so that leg 34 supports frame 26 with cushion 27 at the same height as cushion 13.

The entire chair assembly 10 is locked in position relative to tub 11 by means of a first riser arm 41 mounted to frame 26, which has a swivelly mounted pad 42 at its distal end for bearing against the inner side wall of the tub 11. A second riser arm 43 with its swivelly mounted pad 44 is pivotally mounted to frame 26. As will be explained in greater detail hereinafter, riser arm 43 may be moved laterally by means of a knob 46 to force pad 44 against the outer wall of tub 11, thereby causing the wall portion of tub 11 to be gripped between pads 42 and 44.

Figure 2:
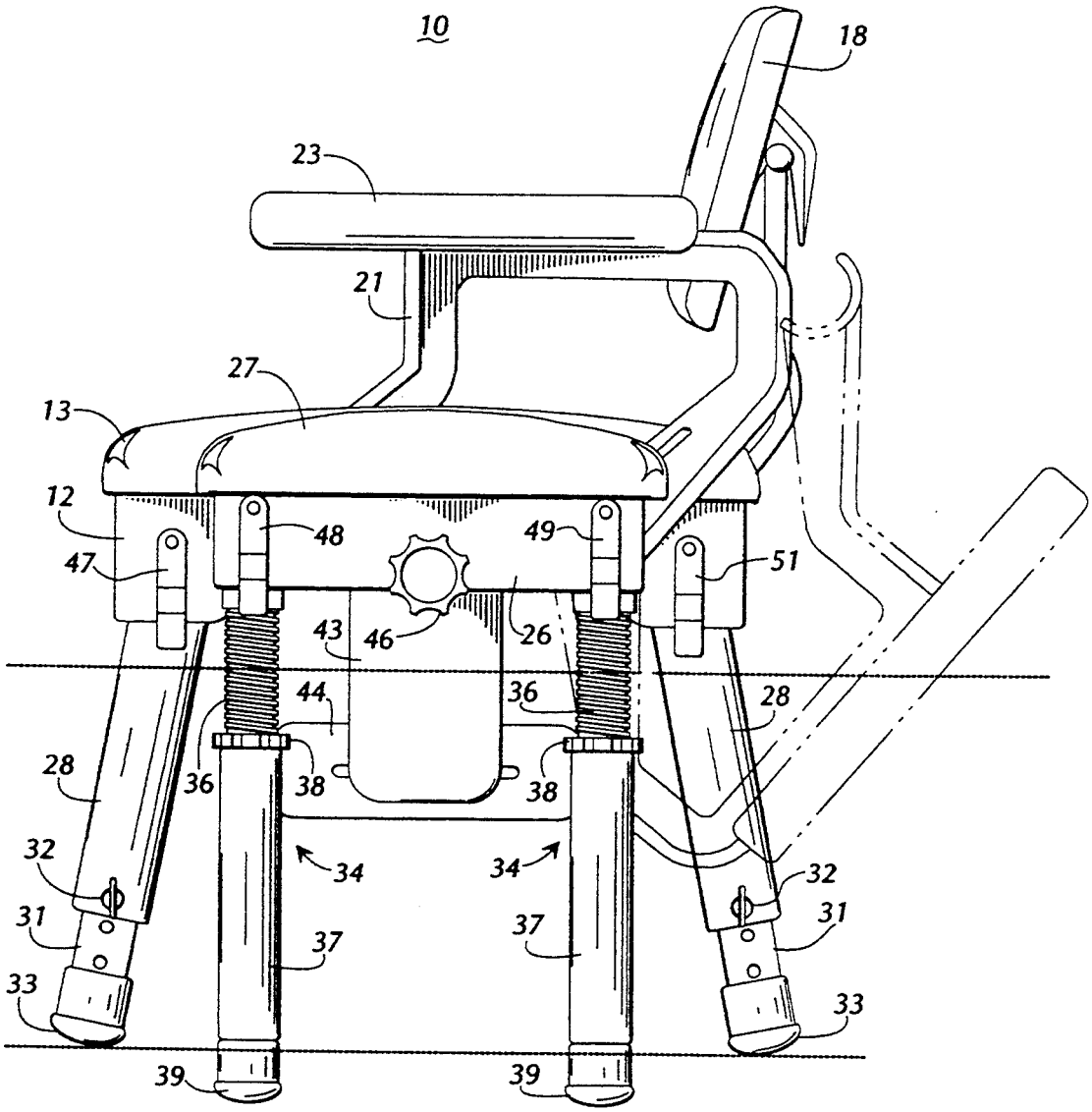
FIG. 2 is a side elevation view of the chair of FIG. 1.

FIG. 2 is a side elevation view of the chair 10 of FIG. 1 which shows how the arm 21, and arm 19 also, can be rotated out of the way to permit a user to slide from bench cushion 27 to seat cushion 13. The mounting of arm 21 will be discussed in greater detail hereinafter. The seat or chair of the present invention is designed to be easily assembled from its component parts and, after use, to be disassembled into its component parts. Inasmuch as such assembly and disassembly is generally to be performed by persons handicapped in the manner discussed hereinbefore, it is desirable that the use of nuts and bolts in holding the elements together be minimized. To this end, leaf spring members affixed to frames 12 and 26, have holding pins mounted on their distal ends, are used to hold the various elements together. Such spring members and pins are shown in FIGS. 1 and 2 as elements 47, 48, 49, 51, 52, 53 and 54. Such spring members and pins make it possible for legs 28,28 and 34,34, for example, to be snapped into place and held in position without application of any torque such as is necessary with nuts and bolts. In addition, for disassembly, the spring members may be easily pushed outward to remove the pins from their retaining holes so that the legs, for example, may be easily removed.

Figure 2A:
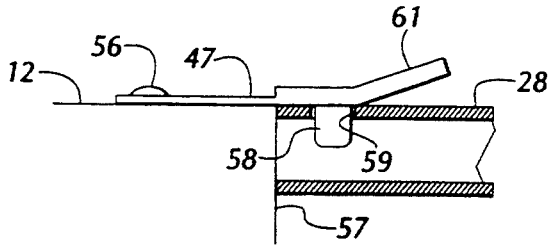
FIG. 2A is a view of the details of a component of the chair of FIGS. 1 and 2.

FIG. 2A depicts, in cross-section, the spring 47 and the manner in which it locks leg 28 in position. Spring 47 is mounted on base 12 by means of a rivet 56 of metal or plastic and extends beyond the lower edge 57 of base 12. A locking pin 58 is mounted on the underside of spring 47 and is adapted to fit within a hole 59 in leg 28. The tension of the spring 47 is such that when leg 28 is inserted into base 12, the pin 58 snaps into hole 59 to lock leg 28 in place. The distal end of spring 47 may be provided with an angular tab 61 which enables the user to lift pin 58 out of the hole 59 to facilitate removal of leg 28 for disassembly of the chair. The springs 47, 48, 49, 51, 52, 53, and 54 as well as others which will be shown hereinafter, all have the same general configuration as that shown in FIG. 2A, and make quick assembly and disassembly of chair 10 possible, without requiring a great deal of effort, or the application of torque, on the part of the user.

Figure 3:
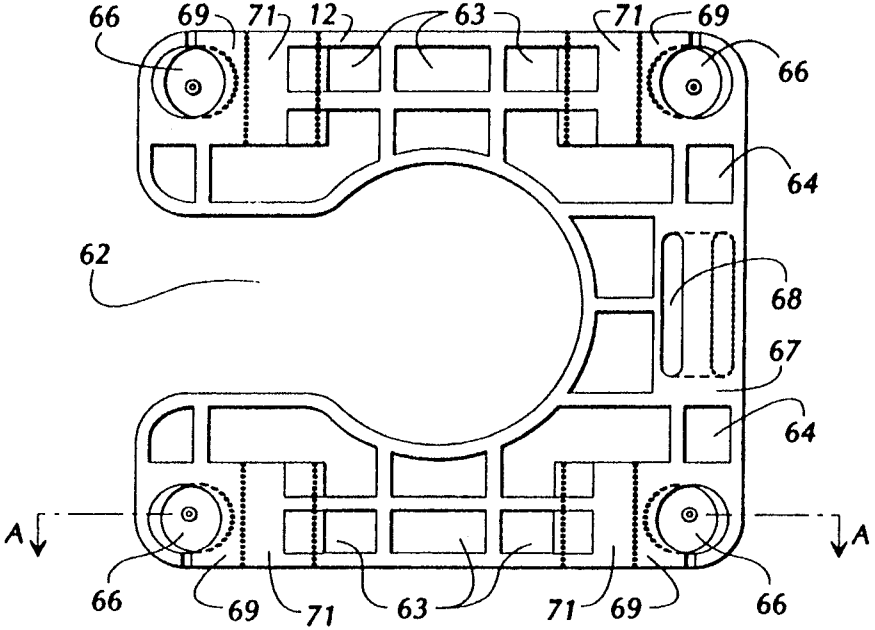
FIG. 3 is a plan view of the lower side of an element or component of the chair of FIGS. 1 and 2.
Figure 3A:
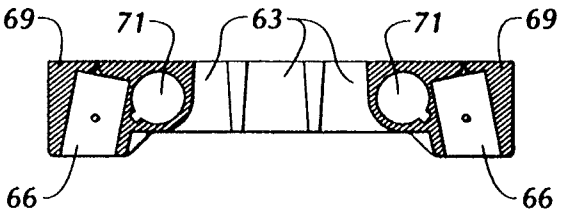
FIG. 3A is a cross-sectional view of the component of FIG. 3.

As thus far described, the chair 10, as depicted in FIGS. 1 and 2, is a lightweight, sturdy device amenable to rapid assembly and disassembly on the part of the user, even though the user may be severely handicapped. As will be apparent hereinafter, the components of the disassembled chair may easily be packed or stowed in a moderately sized suitcase, for example, and carried by the user, or the case may be treated as simply another piece of the user's A feature of the present invention in the cellular construction of base member 12 is shown in FIG. 3 and 3A. FIG. 3 depicts the underside of member 12, which is molded or otherwise formed to receive the various components of the chair 10. As can be seen, base member 12 has a substantially square shape, and an opening 62 therein which is especially useful where the seat 10 is mounted over a toilet. A plurality of openings 63,63 and 64,64 extend through base member 12 and serve to lighten the base member, as well as being adapted to receive the projections 14 extending from the underside of plate 16 on the bottom of cushion 13 to hold cushion 13 in place on base 12. When projections 14 are located in openings or slots 63 and 64, the lateral forces generated by the user sliding out of cushion 13 are resisted so that cushion 13 remains in place. On the other hand, cushion 13 can be easily separated from base 12 by simply being lifted off.

At the corners of base 12 are four angled holes 66,66 which are adapted to receive the legs 28,28, i.e., hollow tubular members 29,29. Holes 66,66 are angled for increased stability, and, as seen in FIG. 3A, a cross-section along the line A—A of FIG. 3, they do not extend all the way through base 12, thereby forming seats against which the members 29,29 bear when assembled. At the rear portion 67 of base 12 is an elongated slot 68 which extends therethrough at an angle, as shown. Slot 68 is adapted to receive back riser 17 for mounting seat back cushion 18 and holding it in place, as will be shown in detail hereinafter.

Base 12 is provided, at the regions of the four corners thereof, bosses or solid portions 69,69 in which holes 66,66 are bored or formed, and through which substantially identical lateral mounting holes 71,71 are bored or otherwise formed and which are used to mount components of the chair including mounting or brace tubes 24, as will be apparent hereinafter. As can be seen in FIG. 3, the base member 12 has symmetry about its longitudinal centerline, so that the components of the chair 10 may be affixed to either side of base 12, depending on the orientation of the bathtub in which the chair 10 is to be placed. Such symmetry insures that regardless of which end of the tub the shower head or the water controls may be located, the chair 10 may be assembled so that the user faces the water controls or the shower head, or both, as desired.

Figure 4:
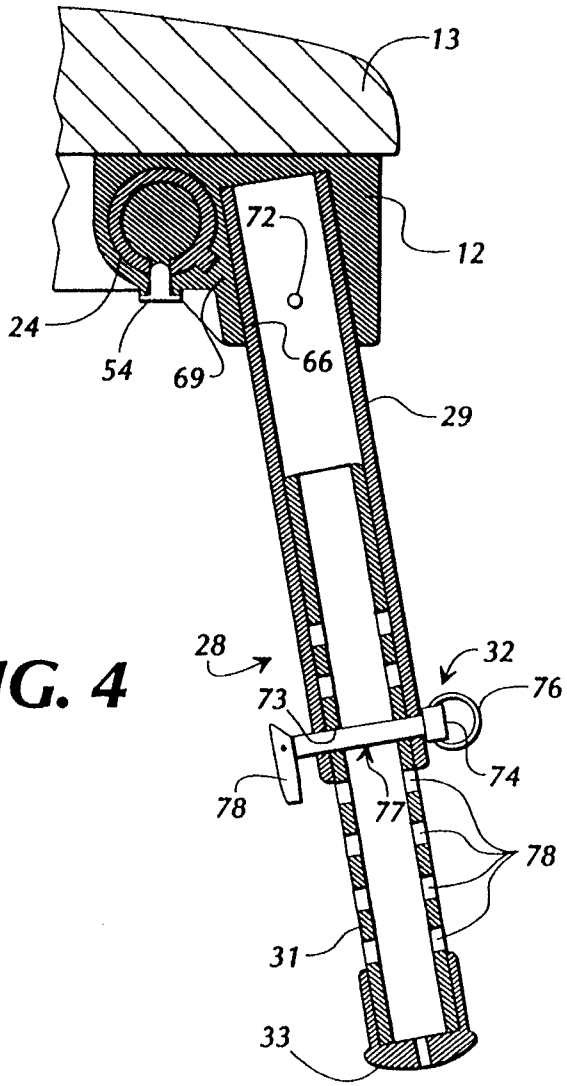
FIG. 4 is an elevation view, in cross-section, of a component of the chair of FIGS. 1 and 2.

FIG. 4 depicts, in cross-section, one of the legs 28 mounted in base member 12. Leg 28 comprises hollow tubular member 29 which is inserted in hole 66 in base member 12 and seated therein. Member 29 has a hole 72 drilled therein adapted to receive locking pin 58 of spring latch 47, for example, to lock member 29 in position. The distal end of tubular member or sleeve 29 has a hole 73 drilled therein for receiving toggle pin or bolt 32, which comprises a head 74 having a swivelly mounted pull ring 76, a shaft 77, and a toggle member 78 pivotally mounted to the distal end of shaft 77. Extension member 31 has a plurality of holes 78,78 drilled therethrough, each being adapted to receive toggle pin shaft 77. Thus, the length of leg 28 may be selectively varied by sliding member 31 within sleeve 29 until the desired holes 78 are aligned with holes 73.

Figure 5:
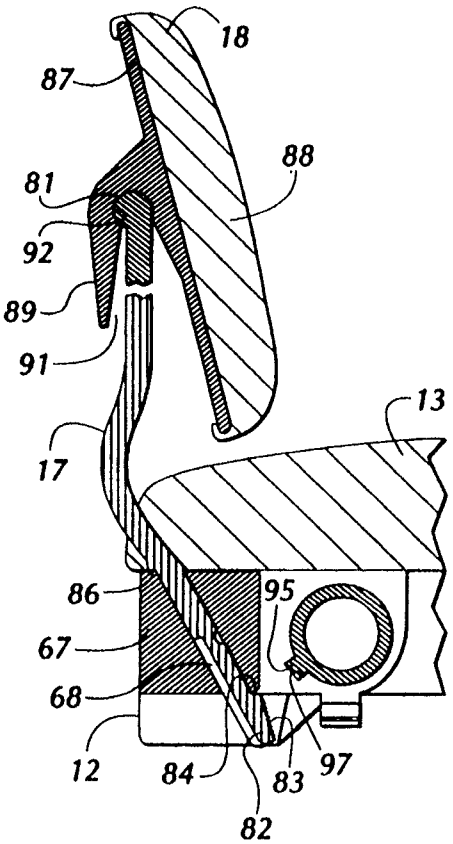
FIG. 5 is an elevation view, in cross-section, of another component of the chair of FIGS. 1 and 2.

In FIG. 5 there is shown, in cross-section, the construction and mounting of the back rest which comprises riser 17 and cushion assembly 18. Riser 17 comprises an elongated member, preferably of a plastic material such as glass reinforced plastic, having at one end an enlarged, rounded portion 81 and at the other end a flattened portion 82 which fits within angled slot or opening 68. Portion 82 has a serrated end 83 which forms a shoulder 84 which bears against member or portion 67 to prevent riser 17 from being accidentally pulled out of slot 68. Flattened portion 82 forms a shoulder 86 with riser 17 which bears against the top surface of portion 67, thereby preventing riser 17 from slipping down into slot 68. When the chair is assembled, portion 82 is slipped into slot 68 until shoulder 84 snaps into place and shoulder 86 bears against member 67. At disassembly, the resilience of portion 82 is such that finger or thumb pressure on serrated portion 83 is sufficient to disengage shoulder 84 so that riser 17 may be pulled out and separated from base member 12. Cushion assembly 18 comprises a substantially flat plastic plate 87 on which a cushion 88 is mounted. Extending from the rear of plate 87 is a plastic bracket member 89 which forms a substantially V-shaped opening 91 with the back of plate 87. The apex of the V-shaped opening 91 has a rounded opening 92 which extends for slightly more than 180° and which contains rounded portion 81 of riser 17. At assembly, inasmuch as bracket member 89 has a resilience characteristic, it is snapped over enlarged portion 81 so that portion 81 rides in rounded opening 92, thereby holding plate 87 on riser 17 but swivelable with respect thereto. At disassembly, a slight outward pull on the depending portion of bracket 89 permits it to be lifted off of riser 17.

Figure 6:
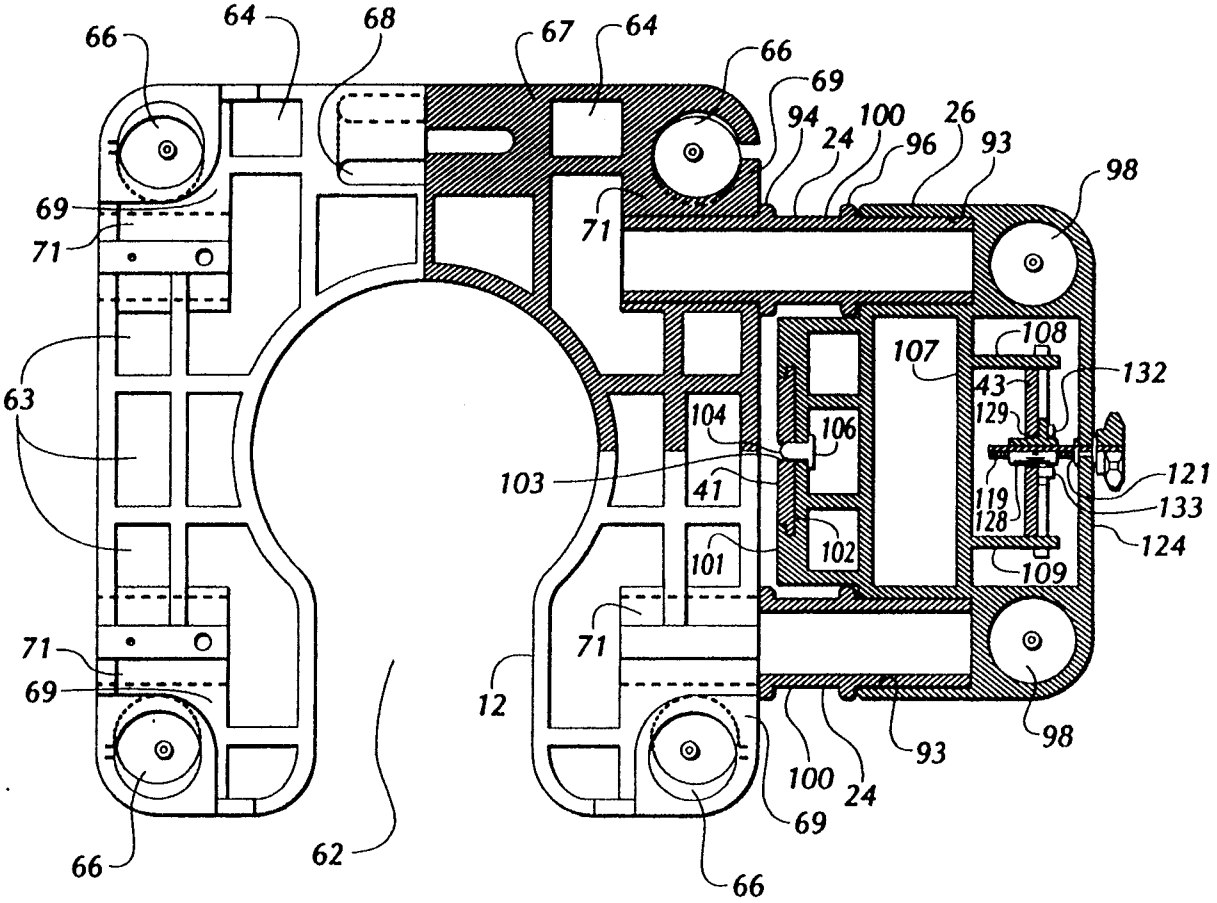
FIG. 6 is a plan view, in partial cross-section, of the underside of several components of the chair of FIGS. 1 and 2, illustrating their relationship to each other as assembled.

FIG. 6 depicts the underside of chair seat frame 12 and auxiliary bench frame 26 mounted to frame 12 by means of brace or mounting tubes 24, which are inserted in lateral mounting holes 71 in frame 12 and in mounting holes 93 in bench frame 26. Tubes 24 are provided with first and second shoulders or ridges 94 and 96 which maintain frames 12 and 26 in spaced relationship, and which are held in place by means of spring and pin members 52. As will be apparent hereinafter, ridges 94 and 96 define a bearing surface 100 for arms 19 and 21. Also, as will be apparent hereinafter, where arm 21 is mounted between frames 12 and 26, ridges 94 and 96 are not necessary. In order that tubes 24 may be rotationally aligned for the pins of members 52 to drop into the holes (see FIG. 4) in tubes 24, tubes 24 are each provided with a key or spline 95 as seen in FIG. 5 which fits into a corresponding keyway 97 in hole 71, as seen in FIG. 5.

Bench frame 26 is also provided with a pair of holes 98,98 which are adapted to receive threaded portions 36 of adjustable legs 34 which also may be locked in place by means of a spring and pin assembly 99 as seen in FIG. 1. Legs 34 will be discussed in greater detail hereinafter.

Frame 26 has a rear support plate 101 which has a stepped slot 102 extending vertically. Vertical riser arm 41 has a stepped cross-section adapted to fit within slot 102, and a hole 103 adjacent the distal end thereof adapted to receive pin 104 of a spring and pin assembly 106. The combination of spring assembly 106 and stepped slot 102 lock first riser arm 41 firmly in place, with swivel pad 42 in position to bear against the inner surface of the side wall of the tub 11.

Figure 7:
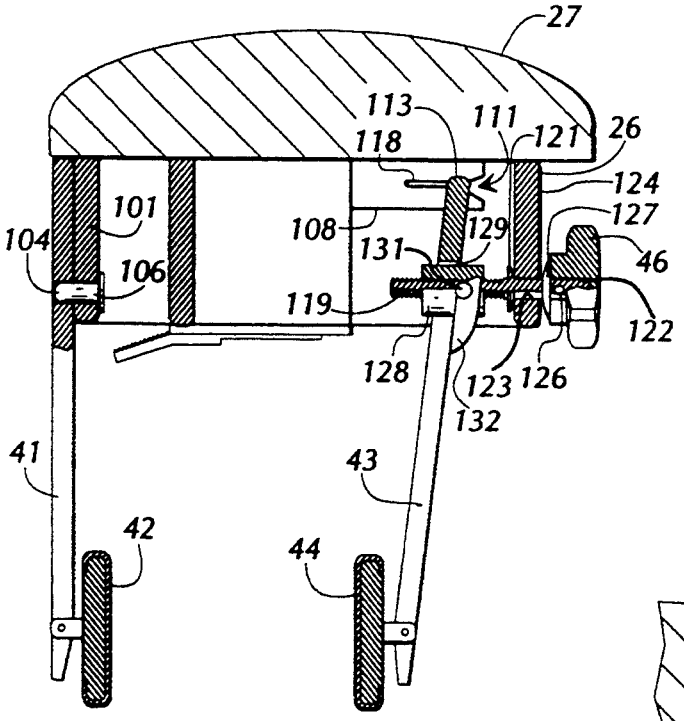
FIG. 7 is a side elevation view, in cross-section, of a portion of the assembly of FIG. 6.
Figure 7A:
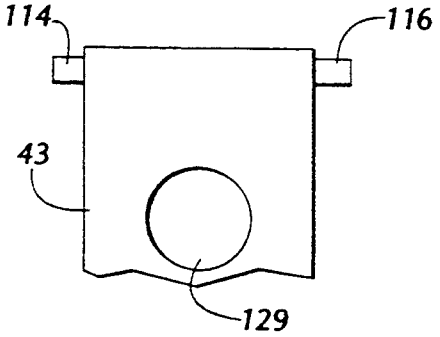
FIG. 7A is a view showing a detail of an element of the assembly of FIG. 7.

With reference to both FIGS. 6 and 7, the mounting of second riser arm 43 can be seen. Frame 26 has a wall or septum 107 extending thereacross from which extend first and second support arms 108 and 109. Arms 108 and 109 are preferably molded with frame 26, but they may be attached thereto by suitable means, if desired. As best seen in FIG. 7, each of arms 108 and 109 has a V-shaped opening 111 with a rounded portion 113 at the apex of the V. As best seen in FIG. 7A, riser arm 43 has, at the top thereof, first and second pivot pins 114 and 116 dimensioned to snap within rounded portions 113 in openings 111, but free to turn with respect thereto. In order that riser arm 43 be held in position, rounded portions 113 each extend slightly over 180°, in the same manner as opening 92 in back assembly 18, as shown in FIG. 5. The resilience of each of arms 108 and 109 may be increased to facilitate inserting pivot pins 114 and 116 in opening 111 by an elongated slot 118 which extends from rounded portion 113.

An adjusting screw 119 has, at one end thereof, a shoulder 121 and an elongated bearing shaft 122 which passes through a hole 123 in outer wall 124 of frame 26. Knob 46 is mounted to shaft 122 by means of a removable pin 126 or other suitable means, and a convex washer 127 is interposed between knob 46 and wall 124. Such a construction makes it possible for adjusting screw 119 to be easily rotated, yet removable of pin 126 makes possible a quick and easy disassembly. Adjusting screw 119 passes through an internally threaded bushing 128, which passes through a hole 129 in riser 43, shown in FIG. 7A. Pivotally mounted on either side of bushing 128 by means of pins 131,131 are first and second actuators 132 and 133 which are adapted to bear against riser arm 43. In operation, as knob 46 is rotated in a clockwise direction, for example, bushing 128 is forced to the left and actuators 132 and 133 push against riser arm 43 moving it to the left and thereby moving swivel pad 44 to the left as viewed in FIG. 7, until it bears against the outer side of the wall of tub 11. For a secure mounting, it is only necessary to finger tighten the assembly with knob 46, thus bench frame 26 and cushion 27 can be securely mounted to tub 11 with only a small amount of torque being applied to knob 46. Inasmuch as seat frame 12 is mounted to bench frame 26 by means of brace tubes 24, then the seat assembly within the tub 11 is likewise firmly fixed in place.

Figure 8:
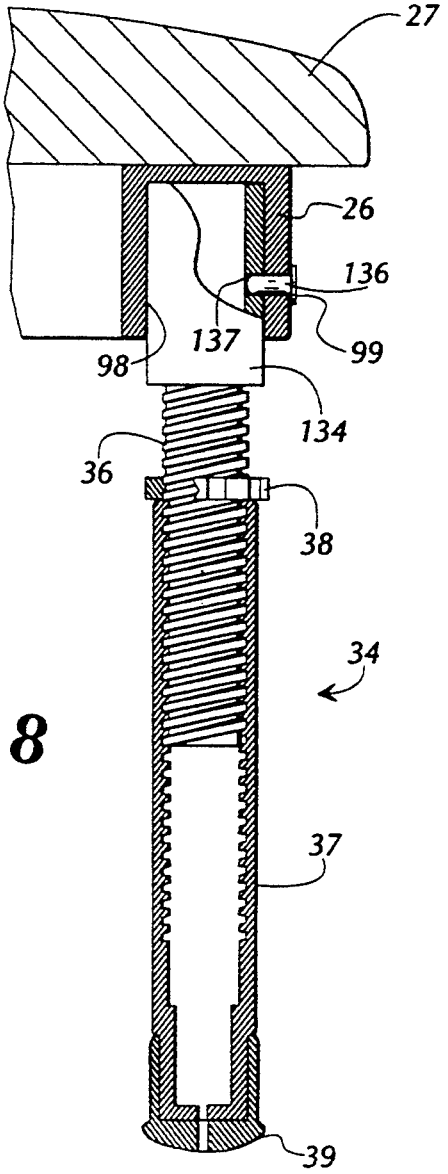
FIG. 8 is an elevation view, in cross-section, of a component of the chair of FIGS. 1 and 2.

Bench frame 26 is supported by two adjustable legs 34 inserted therein, one of which is shown in FIG. 8. Leg 34 comprises a threaded portion 36, the upper end of which terminates in a cylindrical member 134 which, upon assembly, is inserted in hole 98 in frame 26, and locked in place by means of spring and pin assembly 99, the pin 136 of which fits into a hole 137 in member 134. Threaded on to the threaded portion 36 is a hollow, internally threaded sleeve 37 and a locknut 38. The length of leg 34 can be quickly and easily adjusted by rotation of sleeve 37 on portion 36, which is then locked into place by means of locknut 38. It is not necessary that any greater torque than that necessary to cause locknut 38 to bear against the top of sleeve 37 be applied to nut 38 to achieve firm, stable support for frame 26. The lower portion of sleeve 37 is capped by a plastic or rubber foot 39 to prevent slippage.

Figure 10:
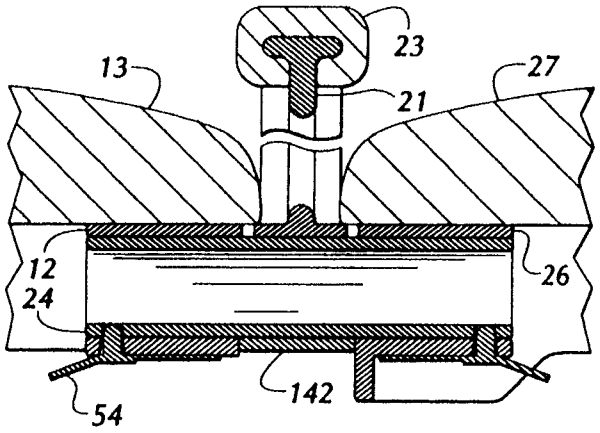
FIG. 10 is a cross-sectional view of the component illustrated in FIG. 9, detailing its mounting on the chair of FIGS. 1 and 2.
Figure 9:
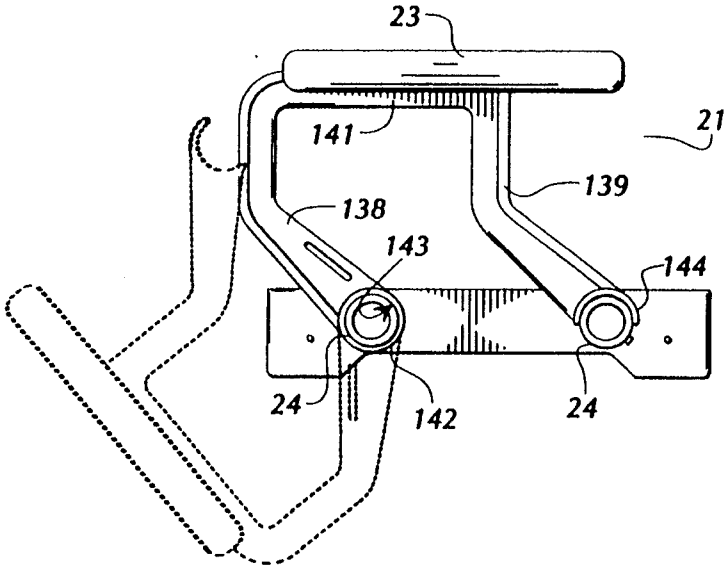
FIG. 9 is an elevation view, in partial cross-section, of still another component of the chair of FIGS. 1 and 2.

The bathtub seat 10 is provided with substantially identical first and second swivelly mounted arms 19 and 21, one of which, arm 21, is shown in FIGS. 9 and 10, mounted between frames 12 and 26. Arm 21 comprises first and second legs 138 and 139 joined by a cross piece 141 upon which cushioned arm rest 23 is mounted. Leg 138 terminates in a circular member 142 having a bore 143 dimensioned to be a slip fit on bearing surface 100 of brace or mounting tube 24. As can be seen in FIG. 10, it is not necessary that tube 24 have ridges 94 to maintain spacing between frames 12 and 26, inasmuch as circular member 142 performs that function. Leg 139 terminates in a semi-circular member 144 which is designed to rest against the front mounting tube 24. When the user wishes to move from bench cushion member 27 to seat cushion member 13, arm 21 can be swung through approximately 130°, as shown in dashed lines, thereby clearing the way for the user to move from the bench or auxiliary seat 26 to the chair seat 12, after which the arm 21 may be returned to its operative position, as shown in FIG. 9.

Figure 11A:
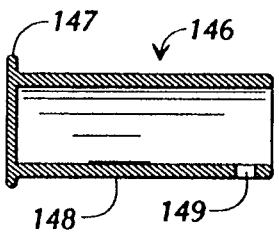
FIGS. 11 and 11A are cross-sectional views of another component of the chair of FIGS. 1 and 2.
Figure 11:
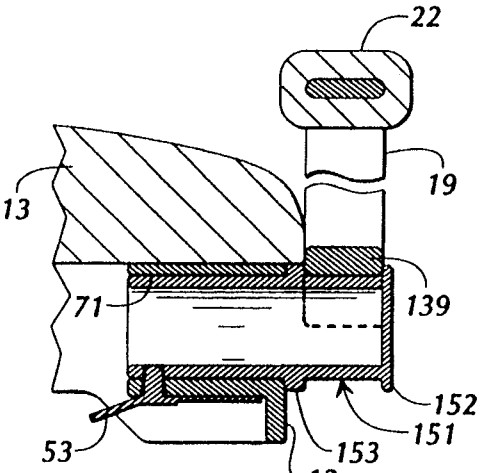

When in its operative position, arm 21 serves to provide lateral stability on one side of the user. Lateral stability on the other side of the user is provided by arm 9, mounted as shown in FIG. 11. Arm 19 is substantially identical to arm 21, with like parts bearing the same reference numerals, and is mounted on a rear brace tube 46, shown in FIG. 11A, which has a retaining flange 147, a bearing surface 148, and a hole 149 for receiving the pin of a pin and spring assembly, not shown. In assembly, tube 46 is passed through the bore 143 of the first arm leg 138 which is then rotable on bearing surface 148, and locked into place by means of the pin snapping into hole 149. The semicircular member 144 of second arm leg 139 rests upon a brace tube 151 in a region defined by first and second flanges or ridges 152 and 153. Brace tube 151 is locked in place by means of a spring and pin assembly 53 and hole 154, as shown in FIG. 11. Arm 19, mounted as shown and described, provides lateral protection for the user so that the combination of arms 19 and 21 holds the user laterally on cushion 13.

It can readily be seen that, because of the symmetry about the centerline of frame 12, bench frame 26 can readily be mounted on the left side of frame 12, (as viewed in FIG. 1), and arm 19 can be mounted on the right side. Thus, the user is able to position the entire seat 10 within the tub 11 so that he or she faces the shower head or the water controls, or both, regardless of which end of the tube they may be located.

From the foregoing description it can be appreciated that seat 10 can be readily assembled and disassembled without the use of special tools, and without the expenditure of any appreciable amount of effort on the part of the user. When disassembled, the component parts can easily be packed in a moderately sized suitcase or carried in a duffle bag, for example, which, because of the unusually light weight of the components, may be easily carried as part of the luggage ensemble in traveling. The chair of the invention is extremely stable in use, provides easy access for the user, and lateral and longitudinal stability so that severely handicapped people may use the chair with safety and confidence.

The invention, in a preferred embodiment thereof, has been shown and described in the foregoing. Numerous modifications may be made to the embodiment as shown by those skilled in the art without departure from the spirit and scope of the invention.

We claim:

1. A handicap chair comprising:

a chair frame including means for supporting a user and having rear and two side portions;

support means detachably mounted to said chair frame for supporting said chair frame at a fixed height;

first and second protective means for providing lateral support for the user disposed at the side portions of said chair frame, said protective means being pivotally mounted to said chair frame;

an auxiliary bench frame member;

means for detachably mounting said bench frame member to one of said side portions of said chair frame;

adjustable support means detachably mounted to said bench frame member for supporting said member at a fixed height;

first clamping means detachably mounted to said bench frame member; and second adjustable clamping means mounted to said bench frame member spaced from said first clamping means and movable toward and away from said first clamping means to fix said handicap chair in a predetermined position, whereby said handicap chair may be supported partially within a bathtub and fixedly positioned relative thereto.

2. A handicap chair as claimed in claim 1 and further comprising a back rest assembly detachably mounted to the rear portion of said chair frame.

3. A handicap chair as claimed in claim 1 wherein said first protective means comprises an arm assembly pivotally mounted between said one side of said chair frame and said bench frame member.

4. A handicap chair as claimed in claim 1 wherein said second protective means comprises a second arm assembly pivotally mounted to said chair frame on the other side from said one side.

5. A handicap chair as claimed in claim 1 wherein said means for detachably mounting said bench frame member to said chair frame comprises first and second brace tube members insertable into said chair frame and said bench frame member.

6. A handicap chair as claimed in claim 5 and further comprising means for locking said first and second brace tube members to said chair frame.

7. A handicap chair as claimed in claim 6 wherein said means for locking comprises a spring and pin assembly mounted to said chair frame.

8. A handicap chair as claimed in claim 5 and further comprising means for locking said first and second brace tube members to said bench frame member.

9. A handicap chair as claimed in claim 8 wherein said means for locking comprises a spring and pin assembly mounted to said bench frame member.

10. A handicap chair as claimed in claim 5 wherein said first protective means is pivotally mounted on said first brace tube member and is adapted to rest upon said second brace tube member when in its operative position.

11. A handicap chair as claimed in claim 5 and further comprising third and fourth brace tube members insertable into said chair frame on the side of said chair frame opposite said one side, and means for locking said brace tube members to said chair frame.

12. A handicap chair as claimed in claim 11, wherein said second protective means is pivotally mounted on said third brace tube member and is adapted to rest upon said fourth brace tube member when in its operative position.

13. A handicap chair as claimed in claim 1 wherein substantially the entire chair is made of a glass reinforced plastic material.

14. A handicap chair as claimed in claim 1 wherein said first clamping means comprises an elongated riser arm detachably mounted at one end thereof to said bench frame member and a clamping member swivelly mounted to the distal end of said riser arm.

15. A handicap chair as claimed in claim 15 and further including means for locking said riser arm to said bench frame member.

16. A handicap chair as claimed in claim 1 wherein said second clamping means comprising a second elongated riser arm pivotally and detachably mounted to said bench frame member and a second clamping member swivelly mounted to the distal end of said second riser arm.

17. A handicap chair as claimed in claim 16 and further including means engaging said second riser arm for moving said second clamping member toward said first clamping member.

18. A handicap chair as claimed in claim 17 wherein said means for moving said second clamping member comprises an elongated adjusting screw, a threaded bushing mounted on said adjusting screw and translationally movable relative thereto, and actuator means pivotally mounted on said bushing adapted to engage said second riser arm.

19. A handicap chair as claimed in claim 18 and further including means mounted on one end of said adjusting screw for rotating said screw.

20. A handicap chair for use with a bathtub wherein the bathtub has an inner floor and an upstanding wall having an inner vertical surface and an outer vertical surface, said chair comprising:

a chair seat frame having an upper portion and a lower portion and side portions;

a removable cushion adapted to be mounted on the upper portion of said chair seat frame;

a plurality of spaced holes in said lower portion of said chair seat frame;

a plurality of length adjustable legs insertable in said spaced holes for supporting said chair seat frame within the bathtub;

a bench frame having an upper portion and a lower portion and side portions;

a removable cushion adapted to be mounted on said upper portion of side bench frame;

at least one hole in said lower portion of said bench frame;

at least one length adjustable leg insertable in said hole in said lower portion for supporting said bench frame exteriorly of the bathtub;

said chair seat frame having at least a first mounting hole extending inwardly from a first one of said portions; said bench frame having at least a second mounting hole extending inwardly from one of said side portions;

a first mounting member insertable into said first and second mounting holes for mounting said bench frame to said chair seat frame;

a first protective arm member adapted to be pivotally mounted on said first mounting member;

a chair seat frame having at least a third mounting hole extending inwardly from a second one of said side portions;

a first support member insertable into said third mounting hole;

a second protective arm member adapted to be pivotally mounted on said first support member; and means for clamping said handicap chair to the bathtub comprising a first riser arm adapted to be mounted at one end to the said lower portion of said bench frame, said riser arm having a gripping member mounted to its other end and being adapted to bear against the inner vertical surface of the bathtub wall, a second riser arm adapted to be pivotally mounted at one end adjacent to the said upper portion of said bench frame, said second riser arm having a second gripping member mounted to its other end and being adapted to bear against the outer vertical surface of the bathtub wall, and means for moving said second gripping member into engagement with the outer vertical surface of the bathtub.

21. A handicap chair as claimed in claim 20 and further including means for locking each of said plurality of length adjustable legs to said chair seat frame.

22. A handicap chair as claimed in claim 20 and further including means for locking said one length adjustable leg to said bench frame.

23. A handicap chair as claimed in claim 20 and further including means for locking said first mounting member to said chair seat frame and to said bench frame.

24. A handicap chair as claimed in claim 20 and further comprising:

a fourth mounting hole extending inwardly from said one of said side portions of said chair frame member;

a fifth mounting hole extending inwardly from said one of said side portions of said bench frame member; and means for supporting said first protective arm member comprising a second mounting member insertable into said fourth and fifth mounting holes.

25. A handicap chair as claimed in claim 24 and further including means for locking said second mounting member to said chair seat frame and to said bench frame.

26. A handicap chair as claimed in claim 20 and further comprising:

a sixth mounting hole extending inwardly from said second one of said side portions of said chair seat frame; and means for supporting said second protective arm member comprising a second support member insertable into said sixth mounting hole.

27. A handicap chair as claimed in claim 26 and further including means for locking said second support member to said chair seat frame.

28. A handicap chair as claimed in claim 20 wherein said bench frame has a slot in said lower portion thereof adapted to receive and hold said one end of said first riser arm, and means for locking said riser arm to said bench frame.

29. A handicap chair as claimed in claim 20 wherein said bench frame has first and second support arms adjacent said upper portion, each of said support arms having a V-shaped opening therein adapted to receive said one end of said second riser arm.

30. A handicap chair as claimed in claim 29 wherein said one end of said second riser arm has first and second projection extending laterally therefrom, each of said projections being adapted to fit within one of said V-shaped openings.

31. A method of assembling a handicap bath chair having a chair seat frame and a seating surface thereon and a bench frame comprising the steps of:

swivelly mounting a protective arm to the chair seat frame;

mounting the bench frame to the chair seat frame with the protective member disposed therebetween and locking the bench frame and the chair seat frame together;

affixing a plurality of adjustable support legs to the chair seat frame;

swivelly mounting a second protective arm to the chair seat frame on the other side thereof from the bench frame;

mounting a plurality of clamping members to the bench frame; and mounting at least one adjustable leg to the bench frame.

32. The method as claimed in claim 31 and further including the step of adjusting the length of the adjustable support legs to place the seating surface of the chair at a desired height.

33. The method as claimed in claim 32 and further including the step of at least one adjusting the length of the at least one adjustable leg on the bench frame to place the bench frame at a desired height.

34. The method as claimed in claim 33 and further including the step of adjusting at least one of the clamping members to clamp the entire bath chair assembly to the bathtub.

* * * * *